US008790042B2

(12) United States Patent
Burkhardt

(10) Patent No.: US 8,790,042 B2
(45) Date of Patent: Jul. 29, 2014

(54) METHOD FOR REPAIRING SUPPORT PILINGS, IN SITU

(76) Inventor: Gregory B. Burkhardt, Lusby, MD (US)

( * ) Notice: Subject to any disclaimer, the term of this patent is extended or adjusted under 35 U.S.C. 154(b) by 220 days.

(21) Appl. No.: 13/401,276

(22) Filed: Feb. 21, 2012

(65) Prior Publication Data

US 2012/0213591 A1 Aug. 23, 2012

Related U.S. Application Data

(60) Provisional application No. 61/457,288, filed on Feb. 18, 2011.

(51) Int. Cl.
*E02D 5/60* (2006.01)

(52) U.S. Cl.
USPC ..... 405/216; 405/8; 405/211; 405/211.1; 405/249

(58) Field of Classification Search
USPC ..... 405/8, 10, 211, 211.1, 216, 231, 232, 405/249
See application file for complete search history.

(56) References Cited

U.S. PATENT DOCUMENTS

| | | | | |
|---|---|---|---|---|
| 4,306,821 | A * | 12/1981 | Moore | 405/216 |
| 4,445,524 | A * | 5/1984 | Angel | 134/113 |
| 2003/0085482 | A1* | 5/2003 | Sincock et al. | 264/32 |
| 2005/0175416 | A1* | 8/2005 | Bae | 405/231 |
| 2011/0129302 | A1* | 6/2011 | Guo et al. | 405/211.1 |

* cited by examiner

*Primary Examiner* — Sean Andrish
(74) *Attorney, Agent, or Firm* — William H. Holt

(57) ABSTRACT

A method for repairing a support piling, in situ, while immersed in water, comprising the steps of encircling a portion of said piling in need of repair above and below the water line in a coffer dam; and evacuating water from said coffer dam for exposing the portion of the piling in need of repair. Repair steps include blasting damaged portions with high pressure water and/or abrasive particles, adding metal support rods where needed, applying zinc or similar metal for protection against electrolysis, and treating the repaired area with a protective coating such as concrete or grout.

4 Claims, No Drawings

METHOD FOR REPAIRING SUPPORT PILINGS, IN SITU

BACKGROUND OF THE INVENTION

The present invention takes advantage of some of the teachings in my earlier, presently pending, U.S. patent application Ser. No. 12/656,416, filed Jan. 28, 2010 (available as U.S. Patent Application Publication Number US2010/0189503 A1, published on Jul. 29, 2010) which claims priority from my earlier U.S. Provisional Patent Application Ser. No. 61/148,037, filed Jan. 28, 2009. The teachings of these earlier applications are incorporated herein by reference.

It is common for bridges, wharves, docks, platforms and similar structures to rest upon, and be supported by pilings, or columns, comprised of wood, or metal, or other materials, including concrete and which are supported above the surface of bodies of water in oceans, lakes, rivers and streams. The water may be salt water, brackish water, or fresh water.

Periodically, it becomes necessary to repair, and/or refurbish and protect such pilings or columns for maintaining integrity and for preventing collapse of the structures that are being supported. Wear and tear on such pilings and columns primarily occurs along a portion subjected to varying heights of water related to tides and/or rise and fall of water levels in lakes, rivers and streams.

SUMMARY OF THE INVENTION

The invention is comprised of a series of steps used for the rehabilitation and repair of pilings or support columns, of concrete, or metal, or wood, and the like, that are in need of repair to correct damage that has been created by exposure to brackish, fresh or salt water.

DESCRIPTION OF THE INVENTION

The invention is comprised of a series of steps taken in concert with a coffer dam which may be constructed and assembled in accord with my pending U.S. patent application Ser. No. 12/656,416. After assembly and placement of the coffer dam about a piling or support column, water is pumped out from the coffer dam to expose a damaged section of the piling or support column. A power wash, typically using ambient water, with pressures on the order of 1,000 to 5,000 pounds per square inch (p.s.i.) is used for removing marine growth and other detritus such as deteriorating concrete which may be cracked chipped or spalled. Damaged steel rebar, if any, can then be removed and the coffer dam cleaned of the detritus. The power wash may likewise be used to remove weakened or damaged or deteriorating wood from wood pilings and support columns, it being understood that the invention is not limited solely to repair of concrete supports.

The coffer dam is then flooded with appropriate liquid for treating the area to be renovated and repaired. In a salt water environment, such liquid may initially be fresh water for removing some salt from the piling at minimal cost; however, it is preferred to complete the removal of salt by flooding the coffer dam with a chemical compound, e.g. a product known under the trademark Chlorid™ brand chlorine reducer, or other similar products, for removing or neutralizing salt. The water or chemical compound is preferably agitated for perhaps as long as 12 to 24 hours through the use of mechanical or pneumatic apparatus.

Thereafter, the treating solutions are pumped or drained from the coffer dam thus providing access for workmen to repair or replace all damaged rebar, apply material such as zinc sheeting, or mesh, for protection against electrolysis, and affix apparatus for monitoring conductivity and any future deterioration. Thereafter a form, or mold, or jacket is located about the support column to allow for pouring and applying concrete, or patching the piling or support column with a no-shrink grout capable of withstanding up to 6,000 p.s.i., more or less. After a suitable lapse of time for curing the cement or grout, the coffer dam is removed, relocated and reused elsewhere.

The coffer dam shown in my U.S. patent application Ser. No. 12/656,416, is also particularly suited for use during repair and metalizing of columns including metal pilings, such as steel pilings. The preferred method includes the steps of installing the coffer dam about the piling, and then pumping out the water and any debris from the coffer dam to expose the length of piling that is in need of repair. This length generally extends from the low water mark to the high water mark. The column or piling is then power washed with surrounding water and/or fresh water which may also contain chloride remover or neutralizer.

Any undesirable coatings or rust are then cleaned from the piling by blasting with sand or other abrasive materials to expose deteriorated portions that need to be removed, replaced, or repaired by, for example, welding compatible steel support members or patches, and then using x-ray techniques to assure proper repair. Refurbishing or repair of the column or piling can then be completed by using sand blasting to shape the piling to the desired profile, metalizing the piling to industry standards at least three feet below the median low water line and, if desired, applying a resistive coating of paint above the high water mark. After a final inspection by the workman, the coffer dam is removed for use at another location.

I claim:

1. A method for repairing a support piling, in situ, while immersed in water, said method comprising the steps of encircling a portion of said piling in need of repair above and below the water line in a coffer dam; evacuating water from said coffer dam for exposing the portion of the piling in need of repair; creating a stream of high pressure water for treating an area of said piling for removing detritus from said piling; draining water from said coffer dam; flooding said coffer dam with a chemical compound for removing accumulated salt from said piling and agitating said compound for multiple hours; removing said compound from said coffer dam for exposing said treated area of said piling; and inspecting said piling to determine the need for additional repairs.

2. The method as defined in claim 1 including the steps of removing undesirable coatings or rust by blasting with abrasive materials for exposing any deteriorated portions of said piling.

3. The method as defined in claim 1, including the step of applying zinc sheeting or zinc mesh to said piling for protection against electrolysis.

4. The method as defined in claim 3 including the steps of locating a form about said piling for allowing pouring and applying concrete, or patching the piling with a no-shrink grout capable of withstanding up to approximately 6,000 p.s.i., allowing a suitable lapse of time for curing the cement or grout, and then removing the coffer dam.

* * * * *